United States Patent [19]

Thompson

[11] 4,304,014

[45] Dec. 8, 1981

[54] VARIABLE VOLUME FLUSHING CISTERN

[75] Inventor: Bruce R. Thompson, Tranmere, Australia

[73] Assignee: United Packages Limited, Brisbane, Australia

[21] Appl. No.: 141,950

[22] Filed: Apr. 21, 1980

Related U.S. Application Data

[63] Continuation-in-part of Ser. No. 964,825, Nov. 30, 1978, Pat. No. 4,219,895.

[30] Foreign Application Priority Data

Dec. 6, 1977 [AU] Australia ..... PD2675

[51] Int. Cl.[3] ..... E03D 1/14

[52] U.S. Cl. ..... 4/325; 4/346; 4/364; 4/390; 4/410; 4/414

[58] Field of Search ..... 4/324–327, 4/340–342, 345, 346, 363–365, 378, 390–396, 379, 380, 249, 405, 410, 413–415

[56] References Cited

U.S. PATENT DOCUMENTS

| | | | |
|---|---|---|---|
| 241,604 | 5/1881 | Bunting, Jr. | 4/346 |
| 320,625 | 6/1885 | Carney | 4/346 |
| 370,433 | 9/1887 | Wellington | 4/346 |
| 413,586 | 10/1889 | Wellington | 4/364 |
| 452,962 | 5/1891 | Beekman | 4/346 |
| 830,280 | 9/1906 | Alexander | 4/346 |
| 1,323,703 | 12/1919 | Linfoot | 4/325 |
| 2,436,679 | 2/1948 | Sprague | 4/410 |
| 2,879,522 | 3/1959 | Stump | 4/410 |
| 3,041,630 | 7/1962 | Williams | 4/326 |
| 3,344,439 | 10/1967 | Davies | 4/326 |
| 3,431,564 | 3/1969 | Davies | 4/325 |
| 3,842,444 | 10/1974 | Gruenhagen | 4/324 |
| 3,968,525 | 7/1976 | Alexander | 4/410 |
| 4,044,407 | 8/1977 | Silcox | 4/325 |
| 4,128,906 | 12/1978 | Raz | 4/325 |
| 4,143,430 | 3/1979 | Joshi | 4/324 |
| 4,144,600 | 3/1979 | Mayes | 4/324 |
| 4,152,793 | 5/1979 | Mills | 4/325 |
| 4,171,547 | 10/1979 | Raz | 4/326 |

FOREIGN PATENT DOCUMENTS

| | | | |
|---|---|---|---|
| 235667 | 8/1960 | Australia | 4/410 |
| 2626053 | 1/1977 | Fed. Rep. of Germany | 4/324 |

*Primary Examiner*—Stuart S. Levy

*Attorney, Agent, or Firm*—Kinzer, Plyer, Dorn & McEachran

[57] ABSTRACT

This invention relates to a variable volume flushing cistern and in particular it relates to a cistern of the type in which a selection can be made of the amount of water discharged during a flush.

3 Claims, 4 Drawing Figures

31
18

32
14
23
22
25
35
27
38
17
17
8
16
15
13
11
40
12
39
6

31
18

32
33
19
14
36
34
36
27
30
17
16
17
8
15
29
7a
7b
39
6

VARIABLE VOLUME FLUSHING CISTERN

CROSS REFERENCE TO RELATED APPLICATION

This application is a continuation-in-part of my copending application, Ser. No. 964,825 filed Nov. 30, 1978, now U.S. Pat. No. 4,219,895.

THE PRIOR ART

It is already known to provide cisterns in which either a low volume or a high volume discharge is possible by selection and these usually have been of the type in which either part of the cistern or the whole of the cistern can be discharged during a flush.

This has for instance been achieved by operating the discharge valve to seal when a certain selected level of water is reached, or it has been attained by use of compartments which vary in volume. In other prior art, such as U.S. Pat. No. 4,143,430, a two compartment cistern is used having a release flap which operates in accordance with how far the operating lever is pulled down.

In apparatus of this type it is desirable to achieve the variable flush in a simple manner and one which is reliable in operation to ensure correct flushing of the toilet pan.

OBJECT OF THE INVENTION

An object of the present invention is to provide a simple and effective variable volume flushing cistern while retaining the normal type of flushing apparatus.

SUMMARY OF THE INVENTION

The object is achieved by having a first compartment which includes the flushing valve, and a second compartment which is isolated from the flushing valve but is provided with a flap whereby the second compartment can also be placed into communication with the flushing valve.

The flap is controlled by a simple volume control mechanism comprising two buttons, one to release the larger volume of water and the other the smaller volume.

Each button is connected to a respective tubular member each of which, upon rotation about a shaft, independently retracts the flushing valve permitting discharge of the water in the cistern. One of the tubular members also is connected to and operates the flap.

The construction of the variable volume flushing cistern can be varied within the spirit of the invention but according to a preferred form the cistern and flushing valve are constructed as heretofore but the first and second compartments are formed by placing a division wall across the cistern body to form a first and second compartment;

a float located within said cistern;

a water inlet in said cistern to be actuated by the float;

a flushing valve in the said first compartment positioned to discharge water from the said first compartment and movable by an operating stem passing through said division wall;

a movable flap forming part of the said division wall to allow the said second compartment to be isolated from the said flushing valve in the said first compartment;

first operating means connected to the said operating stem to actuate the said flushing valve to initiate a large flush from both said compartments; and second operating means connected to said operating stem to actuate the flushing valve and engaging said flap to close the said flap to isolate the said second compartment from the said flushing valve, thus initiating a smaller flush from said first compartment, said division wall having a portion extending over the flushing valve and on one side extending upwardly and on the other side having a portion adapted to be engaged by said flap, the said flap being hinged to the floor of the said body to define with the division wall the said first and the second compartments, said first operating means including a first rotatable member, said first member being operated by a button connected thereto, a second rotatable member position adjacent to said first member, said second member being coupled to the said operating stem by connecting means and said first member being adapted to engage with said second member whereby operation of the button causes the first member to rotate and engage the second member causing the second member to rotate to activate the operating stem to operate the said flushing valve, and said second operating means including a third rotatable member located adjacent the second member and remote from said first member, said third member being operated by a second button connected thereto and having a member projecting therefrom and adapted to engage a projection, extending from said flap in the direction of said first compartment, said third member being adapted to engage said second member whereby operation of the said second button causes the third member to rotate and engage the second member causing the second member to rotate and activate the operating stem to operate said flushing valve, while simultaneously the said member projecting from the third member bears on the flap projection and closes said flap to isolate the said second compartment from the flushing valve to initiate a smaller flush from the said first compartment.

DESCRIPTION OF THE PREFERRED EMBODIMENT

Figure 1:
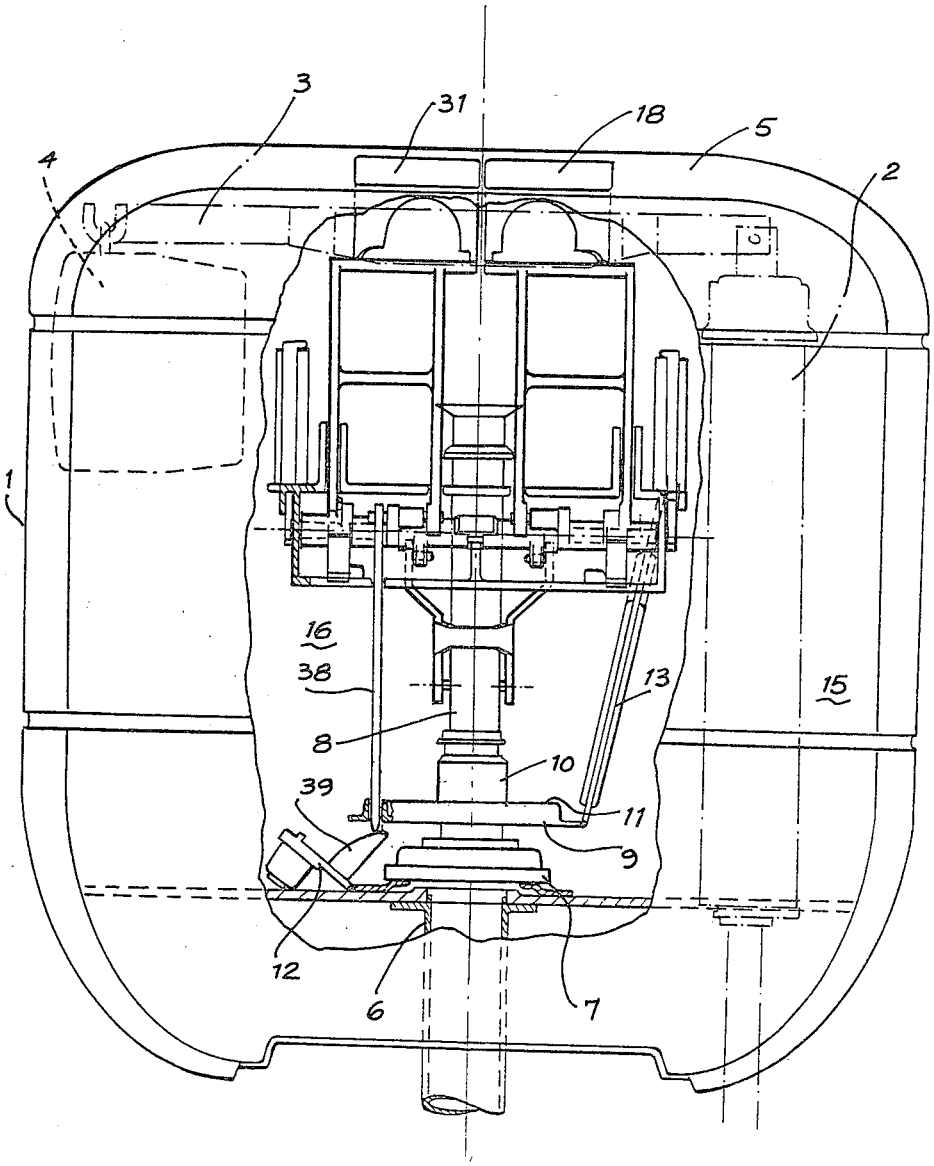
FIG. 1 is a view of one embodiment of the cistern with part of the front wall removed showing the position of the flushing valve and the flap and respective operating means before a flush is initiated.

The body 1, comprising sides and a floor, of the cistern has within it a water inlet valve 2 which is operated through an arm 3 by a float 4 in any suitable manner.

A lid 5 closes the cistern.

The base of the body 1 has an outlet member 6 with a flushing valve 7 resting thereon in the closed position. The flushing valve can be of any suitable construction, however it is shown as a flat disc fitted to a hollow operating stem 8 which forms the cistern overflow.

The flushing valve 7 in operation is retractable into a recess 9 in a guide 10. The recess 9 and the guide 10 are supported from the division wall 11 which extends across the body of the cistern and has an upwardly extending continuation 13 of the wall which again extends across the body of the cistern from front to back to divide the body into two compartments. Also extending across the body is a flap 12 which is hingedly attached to the base of the cistern, and which when closed against the wall 11 completes the partitioning of the two compartments.

From the foregoing it will be realised that as the cistern body 1 is filled with water to the level 14 which level is above the extension 13 of the wall 11, such water will flow over the extension 13 upon flushing of the smaller compartment 2. Therefore the inlet valve 2 can be located in either the smaller compartment 15 (as shown in FIG. 1) or the larger compartment 16, as when one or both of the compartments are flushed the level of the water in the cistern decreases lowering float 4 thus activating the inlet valve 2 upon cessation of the flush.

Figure 3:
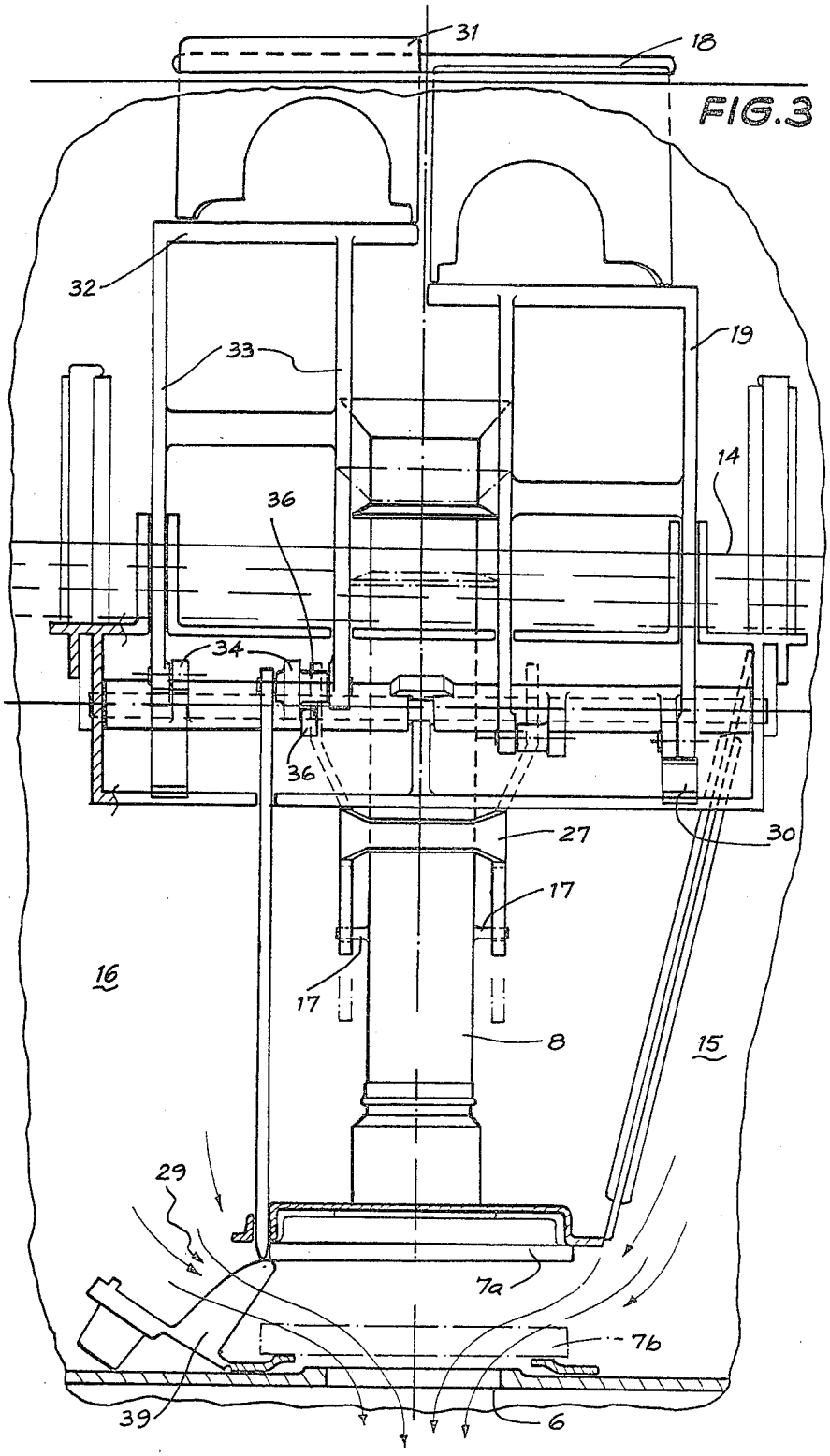
FIG. 3 is a view similar to FIG. 2 but showing the position of the flushing valve, flap and operating means during the large volume flush.
Figure 4:
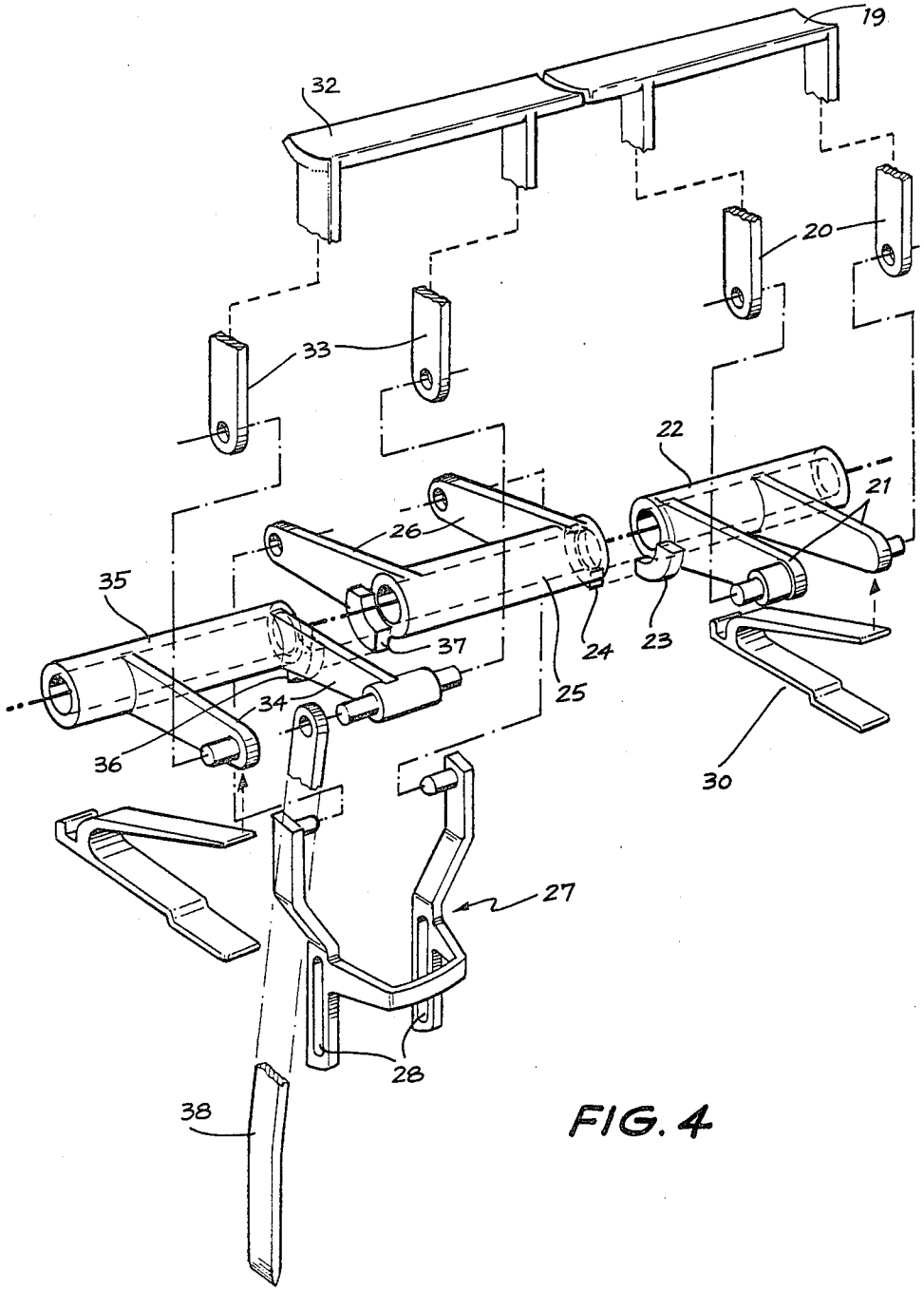
FIG. 4 shows an exploded view of the operating means of the preceding figures.

Turning now to the operation mechanism for flushing of the both compartments, as shown in FIG. 3 and as shown in detail in FIG. 4 there are two projections 17 extending from the hollow operating stem 8. A button 18, extending through the lid 5 operates the flushing valve 7.

The button 18 when depressed, depresses the member 19 which has two extensions 20 hingedly attached to two arms 21 of a first rotatable member 22. The member 19 thereby causes the first rotatable member to rotate. A projection 23 of the first member 22 abuts against a projection 24 on a second rotatable member 25 causing the second member 25 to rotate. The member 25 has two arms 26 extending therefrom which having pivotably connected thereto a connecting member 27 which has two slots 28 located remote from the arms 26, into which the two projections 17 engage.

Therefore upon rotation of member 25 the connecting member 27 raises the operating stem 8 and opens the flushing valve 8. The flap 12 remains in its open position and the water from both compartments flows through the outlet 6. As there is a substantial flow of water through the passage 29 the flap remains in its open position. When pressure on the button 18 is released the rotatable member 22 and the button are returned to their original positions by action of a spring member 30, while the valve 7 is held in the recess 9 by the flow of water through the outlet 6. This spring member 30 can be of any suitable material or construction. Upon cessation of the flow of water the valve 7 which was held in recess 9 by the flow of water through the outlet 6 falls from its position *7a* to *7b* closing the outlet 6.

Figure 2:
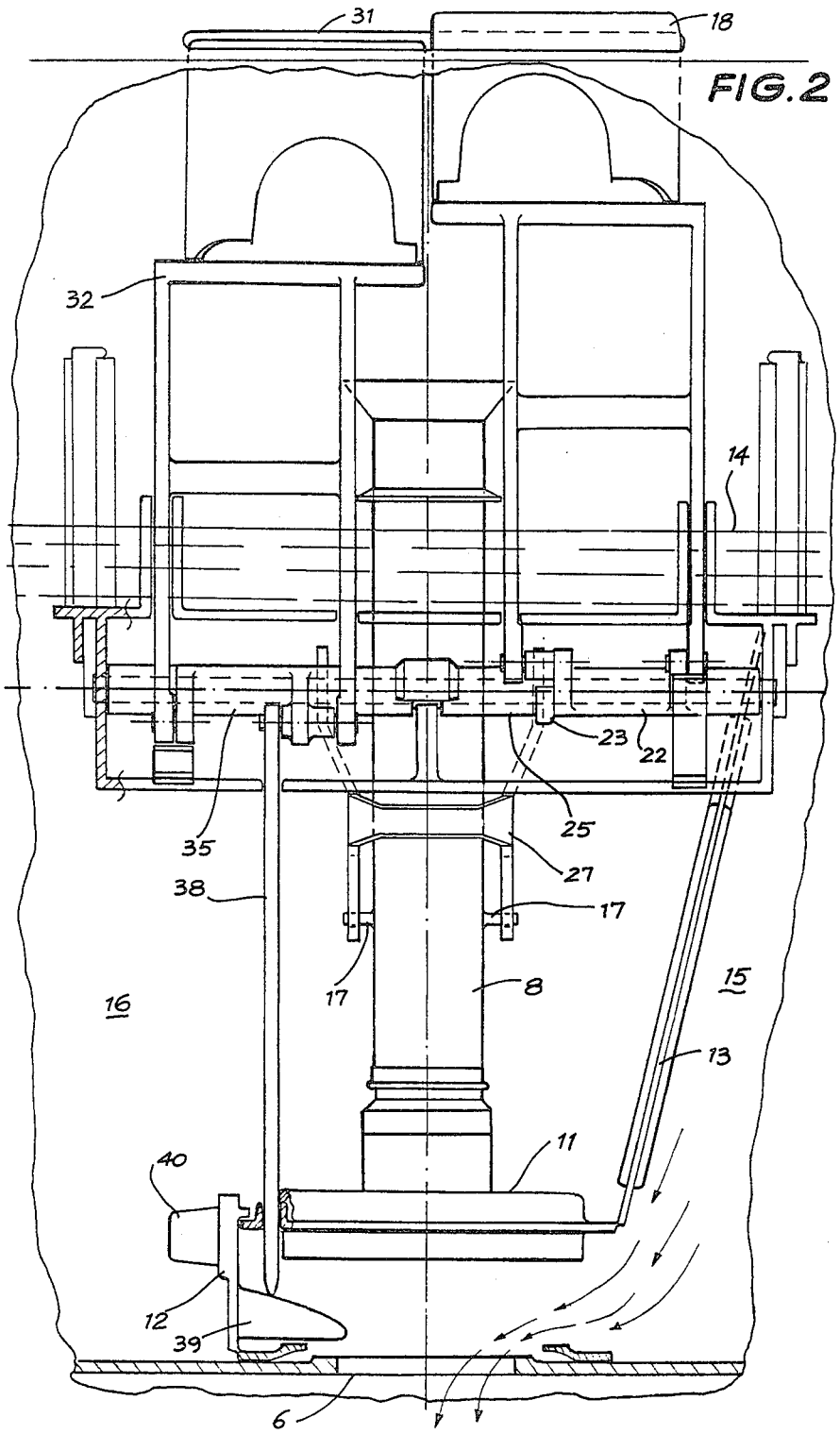
FIG. 2 shows an enlarged view of the flushing valve, flap and operating means during the small volume flush.

To flush only the smaller compartment 15 the button 31 is depressed, as shown in FIG. 2. On being depressed the button 31 depresses member 32 which has two arms 33 extending therefrom. The arms 33 being pivotally connected to arms 34 of a third rotatable member 35 such that the rotatable member 35 rotates and its projection 36 abuts against a projection 37 on the rotatable member 25 thereby rotating the rotatable member 35 and raising the flushing valve 7.

Also pivotably attached to one of the arms 34 is an elongated member 38, which bears against a projection 39 on the flap 12. Upon rotation of the third rotatable member 35 the elongated member 38 bears upon the projection 39 forcing the flap 12 to abut against the wall 11 to isolate the flushing valve 7 from the larger chamber 16. Therefore there is a simultaneous closing of the flap 12 and opening of the flushing valve 7 such that only the volume of water from the smaller compartment 15 and the water above the top edge of the continuation 13 in the compartment 16 flow through the outlet 6. The pressure of water in compartment 16 maintains the flap 12 in its closed position until the smaller compartment 15 refills with water to equalise the pressure across the flap such that the weight of the projection 40 returns the flap 12 to its fully open position. A spring member 40 against one of the arms 34 biases the rotatable member 35 and consequently the button to their original positions.

As can be seen in FIG. 2 and FIG. 3 operation of either button does not move the other button. When the rotatable member 25 is rotated its projections 37 and 24 do not engage the respective projection of the first or third rotatable member which ever is not being rotated.

Although the invention and many of its advantages will be understood from the foregoing description of one form of the invention, it will be apparent that various changes may be made in the form, construction and arrangement of parts without departing from the spirit and scope of the invention as described and claimed.

The claims defining the invention are as follows:

1. A variable volume flushing cistern comprising: a body having a division wall across the cistern body to form a first and second compartment;

a float located within the cistern body; a water inlet valve within the cistern body to be actuated by the float;

a flushing valve in the said first compartment positioned to discharge from the said first compartment and movable by an operating stem passing through said division wall; a movable flap forming part of the said division wall to allow the said second compartment to be isolated from the said flushing valve in the said first compartment;

first operating means connected to the said operating stem to actuate the said flushing valve to initiate a large flush from both said compartments; and second operating means connected to said operating stem to actuate the flushing valve and said flap to close the said flap to isolate the said second compartment from the said flushing valve, thus initiating a smaller flush from said first compartment, said division wall having a portion extending over the flushing valve and on one side extending upwardly and on the other side having a portion adapted to be engaged by said flap, the said flap being hinged to the floor of the said body to define with the division wall the said first and the second compartments, said first operating means comprising a first rotatable member, said first member being operated by a button connected thereto, a second rotatable member positioned adjacent to said first member, said second member being coupled to the said operating stem by connecting means and said first member being adapted to engage with said second member whereby operation of the button causes the first member to rotate and engage the second member causing the second member to rotate to activate the operating stem to operate the said flushing valve, and said second operating means comprising a third rotatable member located adjacent the second member and remote from said first member, said third member being operated by a second button connected thereto and having a member projecting therefrom and adapted to engage a projection extending from said flap in the direction of said first compartment, said third member being adapted to engage said second member whereby operation of the said second button causes the third member to rotate and engage the second member causing the second member to rotate and activate the operating stem to operate said flushing valve, while simultaneously the said member projecting from the third member bears on the flap projection and closes said flap to isolate the said second compartment from the flushing valve to initiate a smaller flush from the said first compartment.

2. A variable volume flushing cistern according to claim 1 wherein said first, second and third rotatable members are all carried by and rotatable about a single shaft and said first rotatable member has a projection which engages a projection on the second rotatable member to rotate said second rotatable member when said first rotatable member is rotated and said third rotatable member has a projection which engages another projection on the second rotatable member to rotate said rotatable member when said third rotatable member is rotated.

3. A variable volume flushing cistern according to claims 1 or 2 wherein said operating stem is hollow and extends above the water level in said cistern, said hollow operating stem extending through said flushing valve to serve as an overflow during any malfunction of the said float actuated water inlet valve.

* * * * *